US006913151B2

(12) United States Patent
Stevenson

(10) Patent No.: US 6,913,151 B2
(45) Date of Patent: Jul. 5, 2005

(54) SYSTEM FOR SORTING AND DELIVERING MAIL

(76) Inventor: Derrell Stevenson, 8206 Prior Way, Antelope, CA (US) 95843

( * ) Notice: Subject to any disclaimer, the term of this patent is extended or adjusted under 35 U.S.C. 154(b) by 133 days.

(21) Appl. No.: 10/283,393

(22) Filed: Oct. 29, 2002

(65) Prior Publication Data

US 2004/0080105 A1 Apr. 29, 2004

(51) Int. Cl.[7] ..... B07C 7/00
(52) U.S. Cl. ..... 209/630; 209/703; 211/10
(58) Field of Search ..... 209/583, 584, 209/630, 702, 703, 900, 942; 211/10, 50, 52; 312/187, 198

(56) References Cited

U.S. PATENT DOCUMENTS

| | | | | |
|---|---|---|---|---|
| 721,950 A | | 3/1903 | Heald | |
| 1,030,317 A | | 6/1912 | Middaugh | |
| 1,035,869 A | | 8/1912 | Field | |
| 1,135,038 A | | 4/1915 | Middaugh | |
| 1,199,524 A | | 9/1916 | Bourn | |
| 1,217,973 A | | 3/1917 | Mann | |
| 1,255,940 A | | 2/1918 | Smith | |
| 1,258,004 A | * | 3/1918 | Heath | 312/198 |
| 1,593,326 A | | 7/1926 | Bourn | |
| 1,698,946 A | | 1/1929 | Edgren | |
| 2,331,175 A | | 10/1943 | Connor et al. | |
| 2,570,636 A | | 10/1951 | Bolling | |
| 2,742,161 A | | 4/1956 | Nuttall | |
| 2,884,139 A | | 4/1959 | Dunham | |
| 3,554,429 A | | 1/1971 | Cohen | |
| 3,696,921 A | * | 10/1972 | Desmond | 206/449 |
| 3,885,668 A | * | 5/1975 | McClain | 312/240 |
| 4,254,875 A | | 3/1981 | Varhelyi | |
| 4,484,685 A | | 11/1984 | Williams | |
| 4,732,279 A | * | 3/1988 | Gurkin | 209/702 |
| 4,889,397 A | * | 12/1989 | Ryan | 312/332.1 |
| 5,810,182 A | | 9/1998 | Levin | |
| 6,332,656 B1 | * | 12/2001 | Gaves | 312/9.14 |
| 6,341,700 B1 | | 1/2002 | Soderstrom | |
| 2004/0060884 A1 | * | 4/2004 | Nook et al. | 211/189 |

* cited by examiner

*Primary Examiner*—Donald P. Walsh
*Assistant Examiner*—Joseph Rodriguez
(74) *Attorney, Agent, or Firm*—Thomas R. Lampe

(57) ABSTRACT

A mail sorting and delivery system in which a portable mail tray is filled with sorted mail while positioned in a compartment having mail dividers. After the portable mail tray has received the sorted mail it is completely removed from the housing along with the mail in the portable mail tray and employed to deliver the mail.

2 Claims, 3 Drawing Sheets

SYSTEM FOR SORTING AND DELIVERING MAIL

TECHNICAL FIELD

This invention relates to a system for sorting and delivering mail. The invention encompasses both an apparatus and a method.

BACKGROUND OF THE INVENTION

When sorting and delivering quantities of mail in post offices and mail centers, it is conventional practice to first organize and separate out the mail by address, utilizing mail cases and mail rack systems. The mail is sorted by hand into compartments of the casing structure formed by dividers and shelves or trays. Once all the mail is placed into the shelf or tray, the mail has traditionally been removed by handfuls and placed into transport trays, sometimes being bundled or banded prior to such placement.

The act of removing the mail from the case or rack by hand after the initial placement is time consuming and there has long been a need to eliminate what amounts to a redundant step in the mail casing process. As will be seen in greater detail below, the invention disclosed and claimed herein eliminates the need to bundle or hand remove the sorted mail for placement into another tray for transport, because once the placement is complete the mail can be transported and delivered in sequence in the tray into which it was placed during the sorting process.

The following United States Patents are believed to be representative of the current state of the prior art in this field: U.S. Pat. No. 6,341,700, issued Jan. 29, 2002, U.S. Pat. No. 4,484,685, issued Nov. 27, 1984, U.S. Pat. No. 1,030,317, issued Jun. 25, 1912, U.S. Pat. No. 721,950, issued Mar. 3, 1903, U.S. Pat. No. 1,035,869, issued Aug. 20, 1912, U.S. Pat. No. 1,135,038, issued Apr. 13, 1915, U.S. Pat. No. 1,199,524, issued Sep. 26, 1916, U.S. Pat. No. 1,217,973, issued Mar. 6, 1917, U.S. Pat. No. 1,255,940, issued Feb. 12, 1918, U.S. Pat. No. 1,593,326, issued Jul. 20, 1926, U.S. Pat. No. 1,698,946, issued Jan. 15, 1929, U.S. Pat. No. 2,331,175, issued Oct. 5, 1943, U.S. Pat. No. 2,570,636, issued Oct. 9, 1951, U.S. Pat. No. 2,742,161, issued Apr. 17, 1956, U.S. Pat. No. 2,884,139, issued Apr. 28, 1959, U.S. Pat. No. 3,554,429, issued Jan. 12, 1971, U.S. Pat. No. 4,254,875, issued Mar. 10, 1981, U.S. Pat. No. 4,732,279, issued Mar. 22, 1988 and U.S. Pat. No. 5,810,182, issued Sep. 22, 1998.

U.S. Pat. No. 6,341,700 discloses a device for sorting documents incorporating a drawer which can be slid either under mail sorting dividers for placement of mail in the drawer or out from underneath the dividers once the mail has been placed in position therein. As the drawer is pulled outwardly, the mail is turned to one side and falls flat onto the bottom of the drawer facing in one direction. Once the drawer has been pulled clear of the dividers and the mail disposed flat on the drawer bottom, the mail is scooped by hand from the drawer (which remains attached to the casing or housing) and placed into another tray or sack for delivery or other processing.

U.S. Pat. No. 4,484,685 discloses a mail sorting rack designed specifically for sorting letter size mail. The mail sorting rack incorporates a tray and mail has to be removed from the tray bottom by hand and bundled and placed into other trays or carrying devices for delivery on the street.

There is no teaching or suggestion in the prior art of the unique system disclosed and claimed herein which utilizes a portable mail tray in the sorting process which is completely removed from the housing or casing employed in the sorting process once sorting has taken place and employed to deliver the mail.

DISCLOSURE OF INVENTION

The apparatus of the present invention is for sorting and delivering mail.

The apparatus includes a housing having a compartment for receiving a portable mail tray, said compartment including a compartment bottom for supporting a portable mail tray and compartment sides extending upwardly from said compartment bottom.

The apparatus further includes a plurality of mail dividers.

Mail divider mounting structure connects the mail dividers to the housing and maintains the mail dividers in a spaced, substantially vertical orientation with said mail dividers disposed in said compartment between said compartment sides and located above and spaced from said compartment bottom.

The apparatus also includes a portable mail tray for selective positioning in the compartment on the compartment bottom below the mail dividers and between the compartment sides or alternatively for complete removal from the compartment and complete separation and disconnection from the housing whereby the portable mail tray can be employed to deliver mail placed into the portable mail tray at the housing.

Other features, advantages and objects of the present invention will become apparent with reference to the following description and accompanying drawings.

MODES FOR CARRYING OUT THE INVENTION

Figure 1:
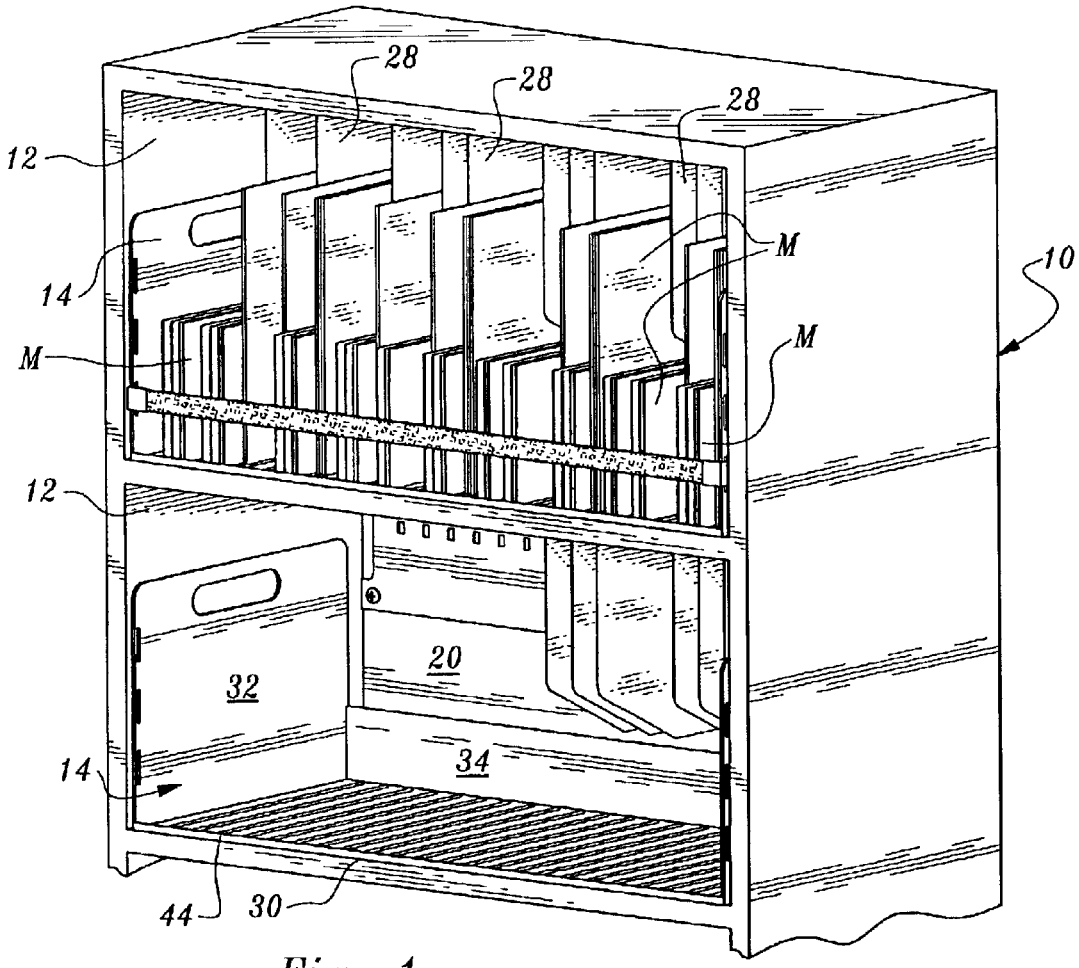
FIG. 1 is a perspective view of a portion of a mail sorting housing or case having two portable mail trays positioned in compartments thereof, one portable mail tray having mail therein and the other portable mail tray being empty.
Figure 2:
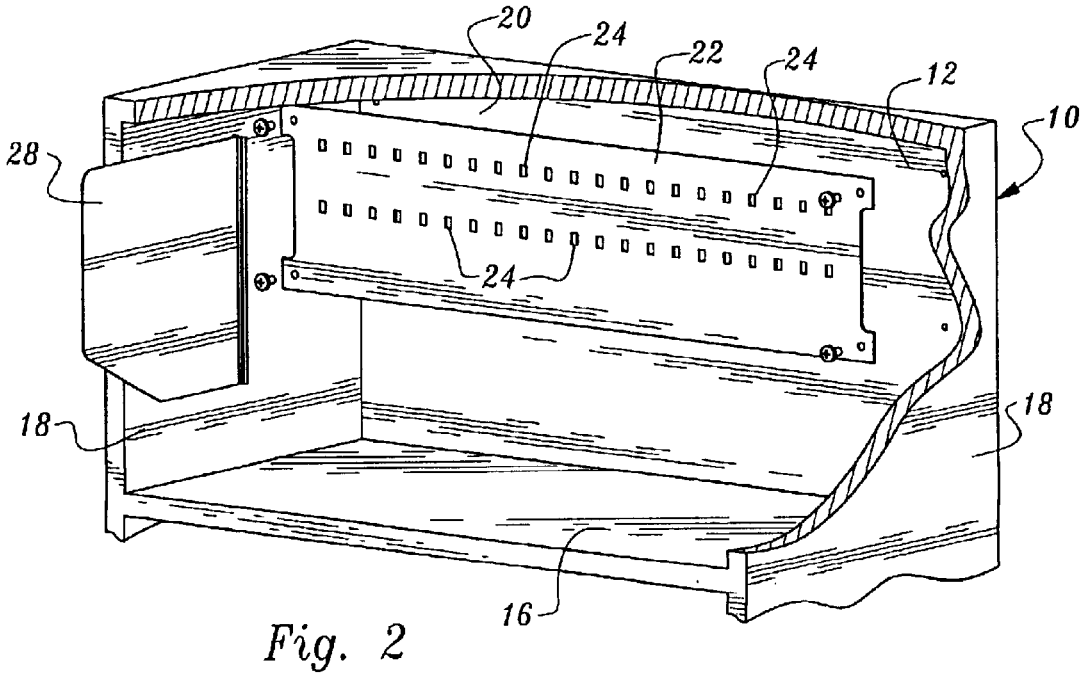
FIG. 2 is an exploded, perspective view of a compartment of the housing with a portable mail tray removed therefrom and illustrating installation of a mounting bracket employed to support mail dividers, one of which is illustrated.

Referring now to FIGS. 1–6, 9 and 10, a preferred embodiment of the present invention is illustrated. The apparatus includes a case or housing 10 having a plurality of mail tray receiving compartments 12, In FIG. 1, two compartments of housing 10 are illustrated, it being understood that one or more additional other compartments may also be incorporated in the case or housing. The compartments 12 are mail tray receiving compartments for the purpose of receiving portable mail trays 14.

As will be seen in greater detail below, the portable mail trays 14 are completely removed from the compartments of housing 10 and completely separated from the housing after the portable mail trays have been filled with sorted mail. The portable mail trays can be utilized effectively for making deliveries of the mail, as will be described in greater detail below.

Housing 10 may be the type of case employed by the U.S. Postal Service and the housing can be readily modified to adapt to the system of this invention. Each mail tray receiving compartment 12 includes a compartment bottom 16 for supporting a portable mail tray and compartment sides 18 extending upwardly from the compartment bottom. Each compartment also includes a compartment rear wall 20. Address labels (not shown) may be disposed along the front of the housing to assist in mail sorting.

To adapt each compartment 12 for use with the system of this invention, a mounting bracket 22 (see FIG. 2) is connected to the compartment rear wall 20 as by means of screws or other types of mechanical fasteners. The mounting bracket 22 extends essentially the full length of the compartment between compartment sides 18.

Figure 9:
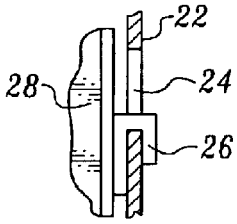
FIG. 9 is a greatly enlarged, cross-sectional view taken along the line 9—9 in FIG. 3.
Figure 10:
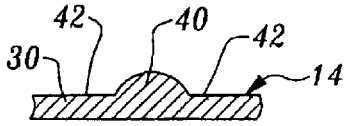
FIG. 10 is a greatly enlarged, cross-sectional view taken along the line 10—10 in FIG. 6.

The mounting bracket 22 has a plurality of openings 24 formed therein. These openings receive hook-like detents 26 of plate-like mail dividers 28 to connect the mail dividers to the housing and maintain the mail dividers in a spaced, vertical orientation with the mail dividers located in the mail tray receiving compartment between the compartment sides. FIG. 9 shows details of the interconnection of a detent and the mounting bracket 22 to support a mail divider 28 and releasably maintain it in a desired position within the compartment. It will be appreciated that the placement of the various mail dividers 28 and distances therebetween may readily be changed, as required. The mail dividers may be formed of any suitable material such as metal or plastic.

Figure 3:
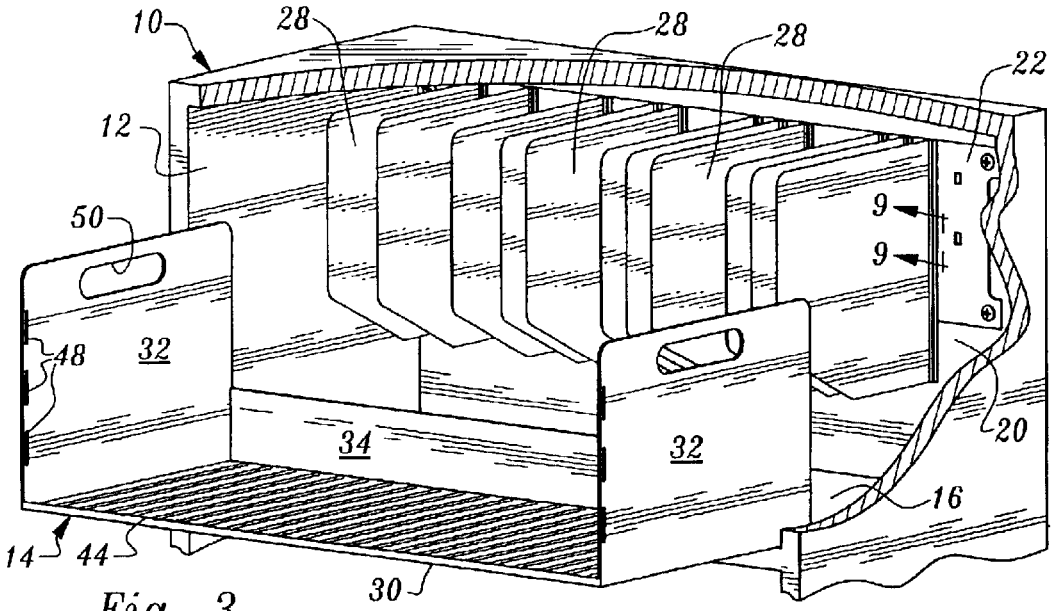
FIG. 3 is a perspective view of a housing compartment having mail dividers installed therein and a portable mail tray just prior to positioning under the dividers.

The mail dividers 28 are spaced from compartment bottom 16. The spacing of the mail dividers 28 from the compartment bottom provides clearance for a portable mail tray 14 so that the latter can be readily slid into position into a compartment on the compartment bottom with the mail dividers disposed thereabove. FIG. 3 shows a portable mail tray 14 in the process of being slid into position within its associated compartment 12.

Portable mail tray 14 may be formed of any suitable material, such as plastic or metal. If plastic, the portable mail tray 14 can be formed as an integral molded structure.

The portable mail tray 14 includes a tray bottom 30, tray side walls 32 extending upwardly from the tray bottom, and a tray rear wall 34 having a height less than the distance between the mail dividers and the compartment bottom. The illustrated portable mail tray embodiment 14 is open at the front so that placement of mail in the portable mail tray through use of the mail dividers 28 can be observed and properly accomplished.

Figure 4:
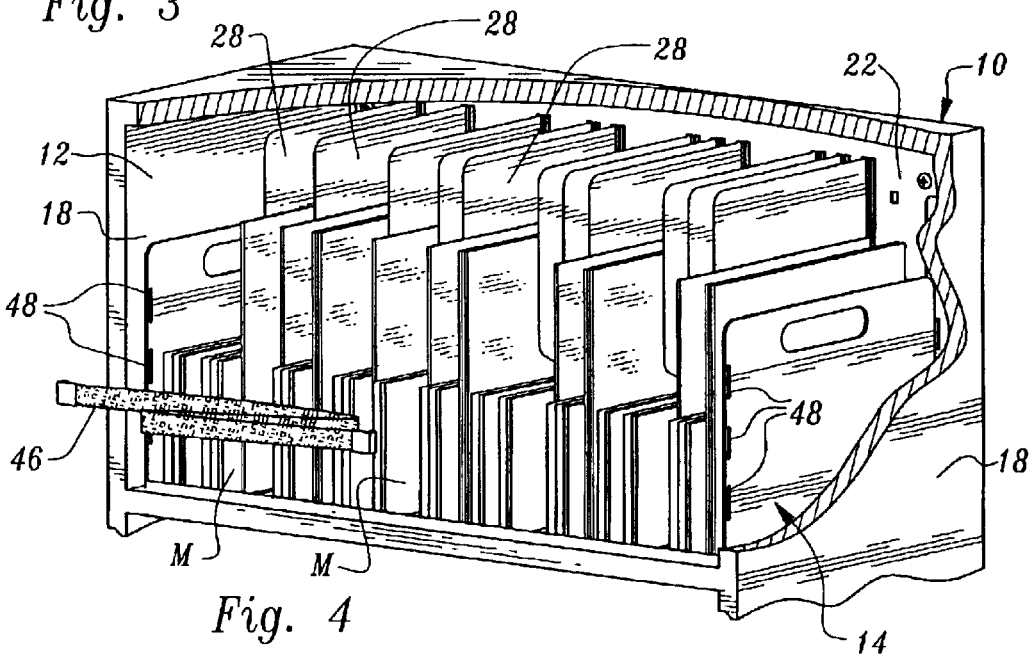
FIG. 4 is a perspective view of the housing compartment of FIG. 3 showing the portable mail tray in position and holding mail which has been sorted and positioned therein, a restraining strap shown prior to attachment to the portable mail tray.

FIGS. 1 and 4 illustrate the uppermost portable mail tray 14 in the housing filled with mail M, grouping of the sorted mail being accomplished and maintained by the mail dividers 28.

Portable mail tray 14 includes a plurality of elongated barrier elements 40 projecting upwardly from the tray bottom. The barrier elements are spaced from one another to define recesses 42 at the tray bottom for engaging and receiving the bottom or lower edges of mail in the portable mail tray to stabilize the mail and resist sideways displacement thereof. In the portable mail tray embodiment under discussion, the barrier elements 40 are elongated ribs spaced from one another disposed parallel to one another and to the tray side walls and orthogonal to tray rear wall 34.

A raised portion in the form of a lip 44 spanning the front of the tray extends upwardly from the tray bottom. The lip assists the user in the placement and removal of the tray and helps retain the mail in place during removal and transport of the mail for delivery. The lip also keeps water or other matter out of the tray.

After the portable mail tray 14 receives its mail, an elongated restraint member in the form of a flexible strap 46 is extended across the open front of the portable mail tray to prevent mail from falling through the open front. The ends of the strap are hooked or otherwise secured in place at openings 48 formed in the tray side walls adjacent to the tray front. Several openings 48 are formed in each tray side wall so that the height of the strap can be adjusted.

Figure 5:
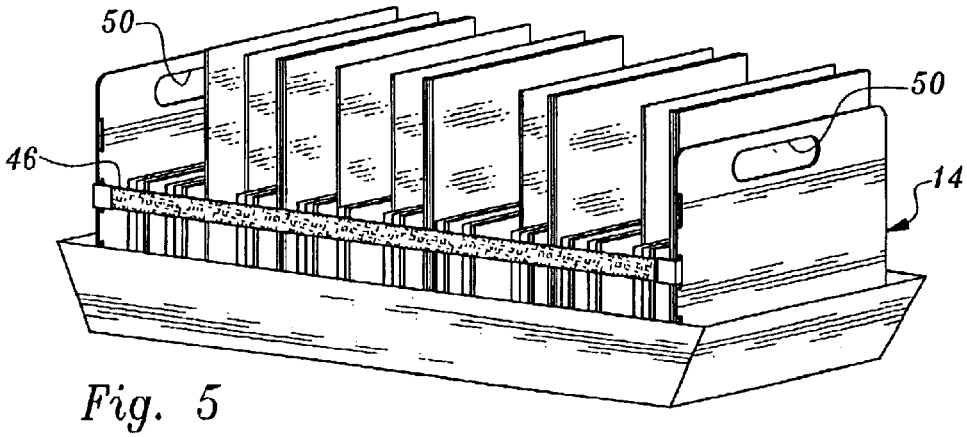
FIG. 5 is a perspective view of the portable mail tray with mail, the tray and mail it contains completely removed and separated from the sorting housing and positioned in a conventional supplemental postal tray of the type commonly used by the United States Postal Service, a barrier strap having been attached to and extending between tray side walls.
Figure 6:
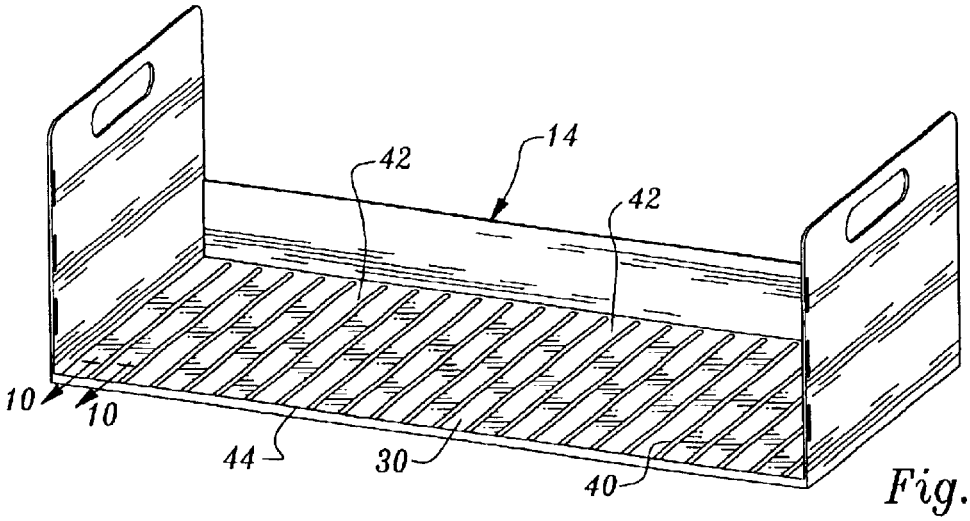
FIG. 6 is a perspective view of the portable mail tray shown in FIGS. 1–5, the tray being empty.

At this point in the operation, the portable mail tray 14 is manually removed from its compartment along with the mail within the portable mail tray. FIG. 5 shows the portable mail tray 14 and the mail it contains completely removed and separated from housing 10.

After mail has been cased into the tray and the tray has been removed from the case, mail can be consolidated within the tray by applying pressure to the middle portion of the last piece of mail to be moved. The mail can then be pushed toward either side wall 32. The bottom edges of the mail pieces will rise over the top of the barrier elements 40.

The feature allows for mail from other trays or sources to be added to the mail tray when the tray is not completely full. This is useful in postal settings as from 10–20 trays may be used in a case. The ability to consolidate the trays in a short time is a time and space saving feature.

Handles are provided in portable mail tray 14 for manually lifting and moving the tray and its contents. More specifically, holes 50 are formed at the upper ends of tray side walls 32 to create handholds. Preferably, the handholds are centered with respect to the tray. The tray side walls are of greater height than the tray rear wall and the tray size is such that the end walls are positioned closely adjacent and parallel to the compartment sides 18 when the portable mail tray is in its compartment to ensure proper positioning of the tray. FIG. 5 illustrates the filled portable mail tray 14 disposed in a supplemental tray 52 of the type commonly employed by the U.S. Postal Service; however, use of a supplemental tray is not necessary for transport of portable mail tray 14 which acts as a separate modular unit that can be utilized by the mail deliverer to transport and deliver the mail to the mail addressees.

Figure 7:
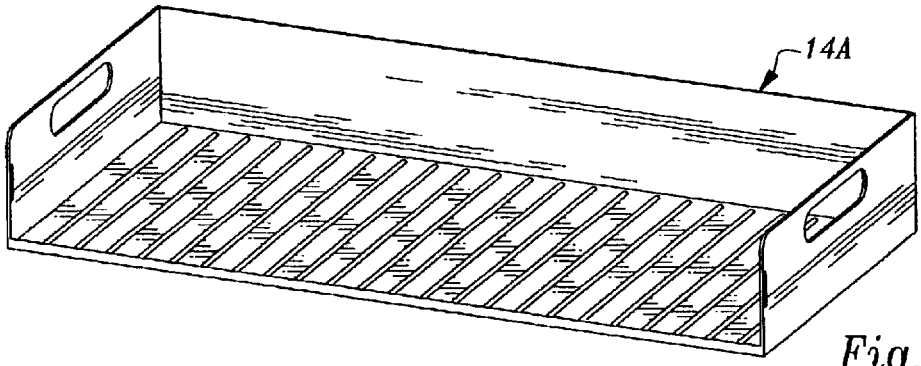
FIG. 7 is a view similar to FIG. 6, but illustrating an alternative embodiment of portable mail tray.

FIG. 7 illustrates an alternate form of portable mail tray 14A in which the tray side walls and tray rear wall are of equal height.

Figure 8:
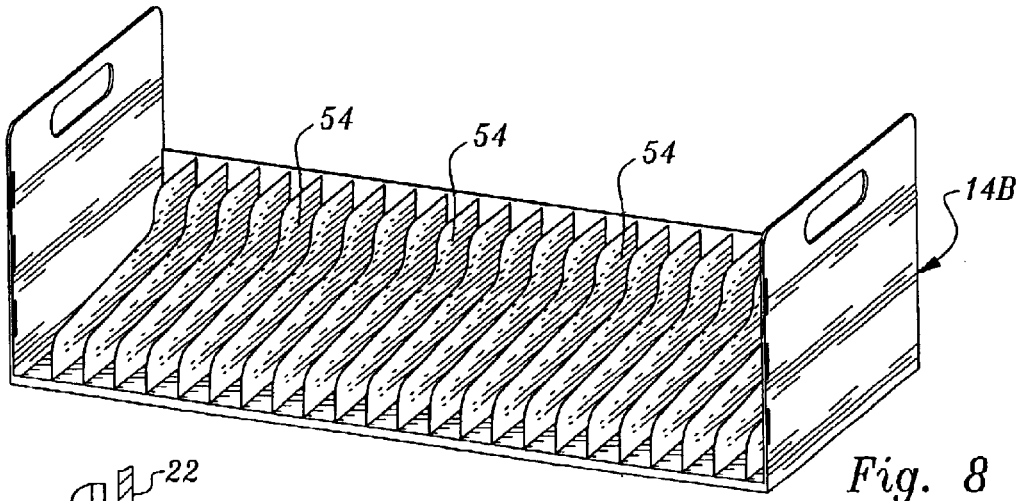
FIG. 8 is a view similar to FIGS. 6 and 7, but illustrating a third embodiment of portable mail tray.

FIG. 8 illustrates yet another version of portable mail tray, tray 14B. In this embodiment the elongated barrier elements

54 have a plate-like construction, the barrier elements having a greater height at the rear thereof than at the front. This particular embodiment is particularly useful when dealing with other than letter size mail, for example magazines.

According to the method of the invention, a portable mail tray having a tray bottom is inserted into a compartment of a housing having a plurality of mail dividers projecting into the interior thereof.

Next, the portable mail tray is positioned at a selected location within the compartment below the mail dividers.

Mail is placed between the mail dividers and into contact with the tray bottom.

After mail has been placed between the mail dividers and into contact with the tray bottom, the portable mail tray is manually removed from the compartment along with the mail in the portable mail tray.

The portable mail tray and the mail in the portable mail tray are completely separated from the housing and transported to addressees of the mail in the portable mail tray to deliver the mail to the addressees.

The method includes the additional step of retaining the mail in the portable mail tray on edge and restraining the mail against sideways movement during the step of transporting the portable mail tray and the mail.

The method further includes the step of providing a mail restraint at an open front end of the portable mail tray after the step of placing mail into contact with the tray bottom.

The invention claimed is:

1. A method for sorting and delivering mail, said method comprising the steps of:

inserting a portable mail tray having a tray bottom, a tray rear wall, tray side walls and spaced barrier elements projecting upwardly therefrom and defining spaced, substantially parallel recesses into a compartment of a housing having a plurality of mail dividers projecting into the interior thereof, the compartment having an open front, a compartment bottom, compartment sides, and a compartment back extending between the compartment sides, and the portable mail tray being inserted through said open front;

positioning said portable mail tray on the compartment bottom at a selected location within said compartment with said tray bottom below said mail dividers and said tray sidewalls located adjacent to and substantially parallel to said compartment sides to promote proper positioning of the portable mail tray and extending upwardly between said compartment sides, and said mail dividers and said recesses extending substantially parallel to said dividers, said compartment sides and said tray sidewalls;

placing mail between said mail dividers and into contact with said tray bottom, with the mail supported on edge in said recesses between said barrier elements to restrain the mail against sideways movement;

after mail has been placed between said mail dividers and into contact with the tray bottom, manually removing the portable mail tray from said compartment through said open front along with the mail within the portable mail tray with said mail on edge in said recesses;

completely separating the portable mail tray and the mail in the portable mail tray from the housing while maintaining the mail on edge; and transporting the portable mail tray with the mail remaining in the portable mail tray to addressees of the mail in the portable mail tray to deliver said mail to said addressees.

2. The method according to claim 1 including the step of sliding at least some of the mail toward an end of the portable mail tray after separation of the portable mail tray from the housing.

* * * * *